US006295734B1

(12) United States Patent
Gilder et al.

(10) Patent No.: US 6,295,734 B1
(45) **Date of Patent: *Oct. 2, 2001**

(54) SAFETY RAZORS

(75) Inventors: Bernard Gilder, Twyford; John Charles Terry, Reading, both of (GB)

(73) Assignee: The Gillette Company, Boston, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/737,833

(22) PCT Filed: Mar. 21, 1996

(86) PCT No.: PCT/US96/03758

§ 371 Date: Jan. 13, 1997

§ 102(e) Date: Jan. 13, 1997

(87) PCT Pub. No.: WO95/09071

PCT Pub. Date: Apr. 6, 1995

(30) Foreign Application Priority Data

Mar. 23, 1995 (GB) ..... 9505917

(51) Int. Cl.[7] ..... B26B 21/22
(52) U.S. Cl. ..... 30/50; 70/52
(58) Field of Search ..... 30/52, 50, 43.92

(56) References Cited

U.S. PATENT DOCUMENTS

| | | | |
|---|---|---|---|
| 1,920,711 | 8/1933 | Pelizzola | 30/12 |
| 2,083,579 | 6/1937 | Schmitt | 30/43 |
| 2,178,976 | 11/1939 | Te Pas | 30/43 |
| 2,181,038 | 11/1939 | Wimberger | 30/43 |
| 2,487,886 | 11/1949 | McCune | 30/50 |
| 2,778,104 | 1/1957 | Coles | 30/30 |
| 3,004,337 | 10/1961 | Schweizer | 30/58 |
| 3,138,865 | 6/1964 | Meyer | 30/34 |
| 3,660,893 | 5/1972 | Welsh | 30/50 |
| 3,722,090 | 3/1973 | Dawidowicz | 30/32 |
| 3,777,396 | 12/1973 | Simonetti | 30/32 |
| 3,786,563 | 1/1974 | Dorion, Jr. et al. | 30/50 |
| 3,842,502 | 10/1974 | Hagan | 30/346.58 |
| 3,871,073 | 3/1975 | Nissen et al. | 30/34.3 |
| 3,871,077 | 3/1975 | Nissen et al. | 30/63 |

(List continued on next page.)

FOREIGN PATENT DOCUMENTS

| | | | | |
|---|---|---|---|---|
| 3303095 | | 8/1983 | (DE) . | |
| 0-094128 | | 5/1983 | (EP) | B26B/19/38 |
| 560239 | | 3/1993 | (EP) | B26B/21/22 |
| 2379357 | | 9/1978 | (FR) . | |
| 1369101 | | 10/1974 | (GB) | B26B/21/54 |
| 2 117 340B | | 10/1983 | (GB) | B26B/21/22 |
| 7506-985 | | 12/1976 | (NL) . | |
| WO91/19596 | * | 12/1991 | (WO) | 30/50 |
| WO 92/17322 | | 10/1992 | (WO) | B26B/21/22 |
| WO92/17322 | * | 10/1992 | (WO) | 30/50 |
| 9509071 | | 4/1995 | (WO) . | |

*Primary Examiner*—Kenneth E. Peterson
(74) *Attorney, Agent, or Firm*—Edward S. Podszus

(57) ABSTRACT

A safety razor blade unit has a guard (2), a cap (3) and three parallel blades (11, 12, 13) mounted between the guard and cap, at least one of the blades, guard and cap being movable from an at rest (non-shaving) position to modify a blade exposure dimension to attain a target blade geometry, at which shaving is initiated, in which the exposure of the first blade (11) is not greater than zero and the exposure of the third blade (13) is not less than zero. At least one of the cap (3) and guard (2) can be movable against the force of a spring (21 or 20) from an at rest position in which all the blades between the guard and cap have their cutting edges disposed below a plane tangential to the skin contacting surfaces of the guard and cap. The blades can be independently sprung or carried for movement in unison on a carrier pivotally mounted in a frame of the blade unit.

54 Claims, 5 Drawing Sheets

U.S. PATENT DOCUMENTS

| | | | | |
|---|---|---|---|---|
| 3,909,939 | | 10/1975 | Dootson | 30/34.2 |
| 3,938,250 | | 2/1976 | Perry | 30/346.57 |
| 4,044,463 | | 8/1977 | Tietjens | 30/34.2 |
| 4,146,958 | | 4/1979 | Chen et al. | 30/47 |
| 4,168,571 | | 9/1979 | Francis | 30/47 |
| 4,189,832 | | 2/1980 | Harper et al. | 30/34.2 |
| 4,200,976 | | 5/1980 | Gooding | 30/47 |
| 4,270,268 | * | 6/1981 | Jacobson | 30/50 |
| 4,337,575 | * | 7/1982 | Trotta | 30/50 |
| 4,345,374 | * | 8/1982 | Jacobson | 30/50 |
| 4,443,940 | * | 4/1984 | Francis et al. | 30/50 |
| 4,501,067 | | 2/1985 | Duncan | 30/63 |
| 4,586,255 | | 5/1986 | Jacobson | 30/41 |
| 4,741,103 | | 5/1988 | Hultman | 30/34.2 |
| 4,774,765 | * | 10/1988 | Ferraro | 30/50 |
| 4,837,930 | | 6/1989 | Righi | 30/47 |
| 4,854,042 | | 8/1989 | Byrne | 30/34.1 |
| 4,860,449 | | 8/1989 | Duncan | 30/47 |
| 4,932,122 | * | 6/1990 | Shurland et al. | 30/50 |
| 5,067,238 | | 11/1991 | Miller et al. | 30/34.2 |
| 5,224,267 | * | 7/1993 | Simms et al. | 30/50 |
| 5,251,376 | | 10/1993 | Althaus et al. | 30/50 |
| 5,313,706 | * | 5/1994 | Motta et al. | 30/50 |
| 5,369,885 | * | 12/1994 | Ferraro | 30/50 |
| 5,402,574 | * | 4/1995 | Milner | 30/50 |
| 5,410,812 | | 5/1995 | Althaus | 30/77 |
| 5,416,974 | * | 5/1995 | Wain | 30/50 |
| 5,426,851 | * | 6/1995 | Gilder et al. | 30/50 |
| 5,546,660 | * | 8/1996 | Burout et al. | 30/50 |
| 5,551,153 | | 9/1996 | Simms | 30/41 |
| 5,611,145 | * | 3/1997 | Wetzel et al. | 30/43.92 |
| 5,669,139 | | 9/1997 | Oldroyd et al. | 30/47 |
| 6,212,777 | | 4/2001 | Gilder et al. | 30/50 |
| 6,216,349 | | 4/2001 | Gilder et al. | 30/50 |
| B1 4,407,067 | | 5/1987 | Trotta | 30/50 |

* cited by examiner

SAFETY RAZORS

This invention relates to safety razors and is particularly concerned with safety razors having blade units with a plurality of blades defining parallel sharpened edges arranged to pass in succession over a skin surface being shaved. The invention is applicable to safety razors having their blade units permanently attached to the razor handle, and to safety razors having their blade units detachably mounted on the handle for replacement when the blade edges have become dulled, and in either case the invention can be incorporated whether the blade unit is immovably mounted to the handle or mounted to move, e.g., to pivot about an axis parallel to the blade edges, relative to the handle under the influence of forces imparted on the blade unit during shaving.

The present invention has specific reference to safety razor blade units incorporating three blades, and the relative positioning of the blade edges. Our prior patent application No. PCT/US94/10717 teaches that with such blade units an improved overall shaving performance can be achieved when the blade edges are set according to a particular geometrical pattern, namely with the first blade, which has its edge nearest the guard, having an exposure not greater than zero, and the third blade, which defines the edge nearest the cap, having an exposure not less than zero. In the most efficacious geometrical arrangement, the first or primary blade has a negative exposure with an absolute value in the range of 0 to 0.2 mm, preferably equal to about −0.04 mm for a primary blade span of around 0.7 mm, the third blade has an exposure with a positive value not greater than about +0.3 mm (preferably less than +0.2 mm), for example around +0.06 mm or +0.09 mm, and the second blade has an exposure of about zero, the second and third blade spans each being 1.0 to 2.0 mm, preferably about 1.5 mm. For convenience the geometrical arrangements described and claimed in the aforementioned prior application are referred to herein as "the target geometry for the blades". For further information and details of the blade geometry reference may be made to the earlier application the contents of which are incorporated herein by this reference.

The blade exposure is defined to be the perpendicular distance or height of the blade edge measured with respect of a plane tangential to the skin contacting surfaces of the blade unit elements next in front of and next behind the blade edge. This can be a positive number if the blade edge is above this plane i.e., closer to the skin surface to be shaved than the tangential plane, or a negative number if the blade edge is below this tangent plane, i.e., further away from the skin than the tangent plane. The span of a blade is the distance from the blade edge to the skin contacting element immediately in front of that edge as measured along a tangent line extending between said element and the blade edge.

The three-blade geometry specified above is applicable to a blade unit in which the blades are immovably mounted relative to the guard and cap. It also applies to the initial or at rest geometry in the case of a blade unit in which the blades are spring mounted and capable of being deflected under the forces applied to the blades during shaving.

The present invention, recognizes that it may be desirable for some parts of a blade unit to be movable relative to other parts and that this may be accommodated without forfeiting the advantages of the blade geometry discussed above. Thus, according to a preferred embodiment of the present invention there is provided a safety razor blade unit comprising a guard, a cap, and first, second and third blades with parallel sharpened edges located in sequence between the guard and cap, at least one element selected from the blades, guard and cap being movable from a non-shaving position (i.e., at rest position not loaded by shaving forces) to modify a blade exposure dimension of the blade unit and to attain a modified blade geometry (also referred to as the target geometry) wherein the exposure of the first blade is not greater than zero and the exposure of the third blade is not less than zero, at least one of the first and third blades having a different exposure when the at least one movable element is in the non-shaving position.

The at least one element can be lightly biased, such as by means of a spring, to an initial, non-shaving (at rest) position at which the target geometry of the blades does not apply, but when the blade unit is applied to the skin during shaving the at least one element can be displaced to a position in which the target geometry of the blades is attained.

The at least one element can comprise the guard and/or the cap and/or one or more of the blades.

In accordance with another aspect the present invention provides a safety razor blade unit comprising a guard, a cap and a plurality of blades with a parallel sharpened edges located in succession between the guard and cap, at least one of the guard and cap being movable against a spring force from a non-shaving (at rest) position to a predetermined operable position in which a modified blade geometry target geometry is obtained, in the non-shaving position the blade edges being disposed below a plane tangential to the skin contacting surfaces of the guard and cap.

A full understanding of the invention will be gained from the following detailed description in which reference is made to the accompanying drawings, wherein.

Figure 2:
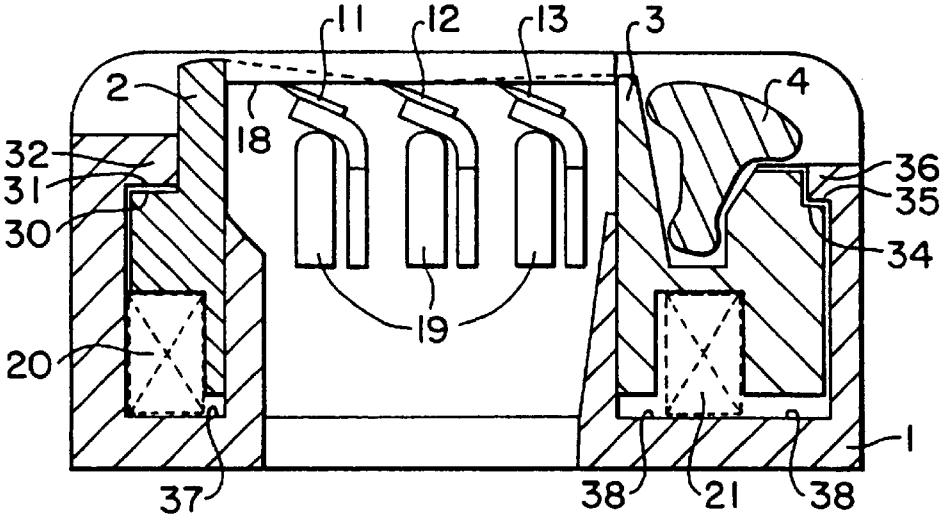
FIG. 2 is a transverse cross-section through a first embodiment of the present invention when not in use.
Figure 3:
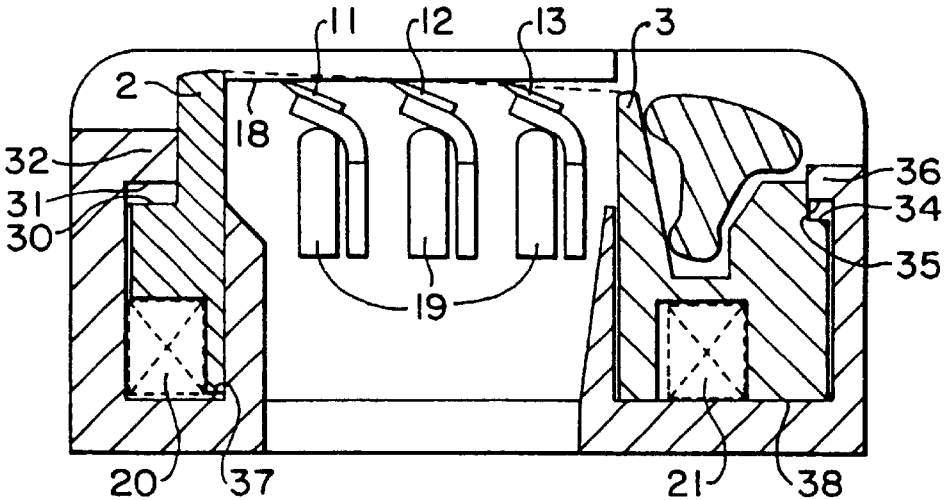
FIG. 3 shows the blade unit of FIG. 2 with the parts occupying different relative positions.
Figure 4:
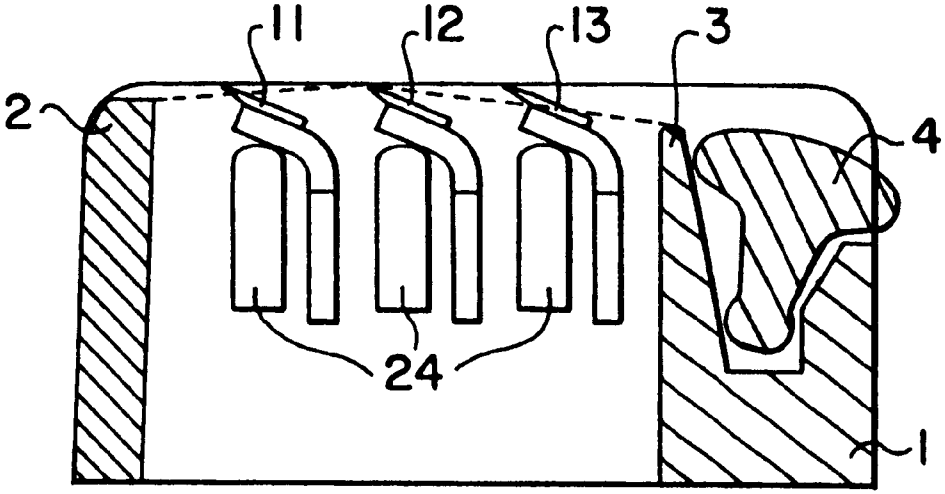
Figure 5:
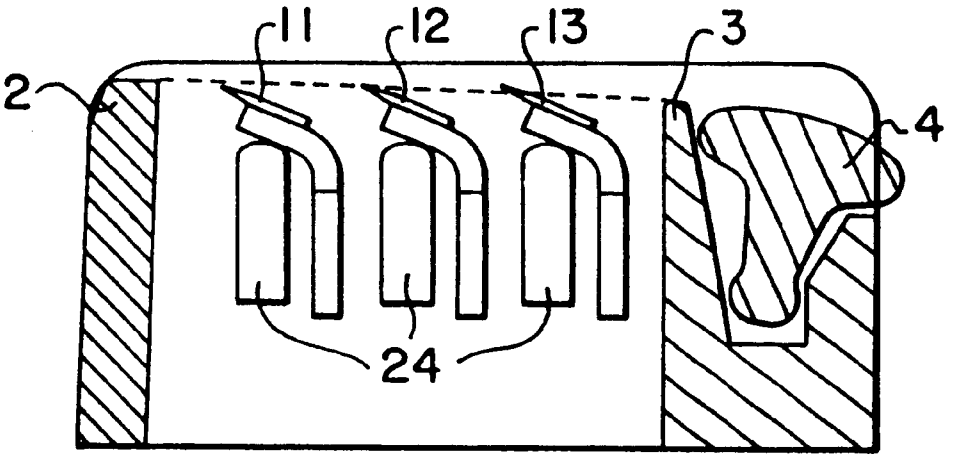
Figure 6:
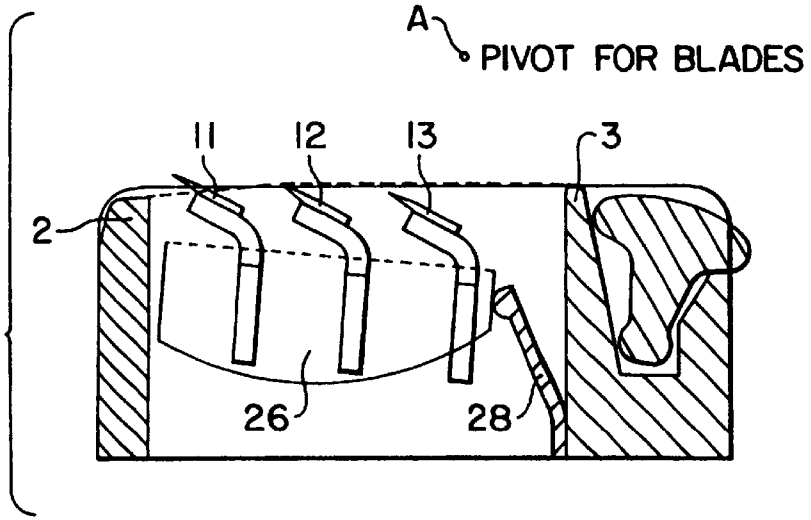
Figure 7:
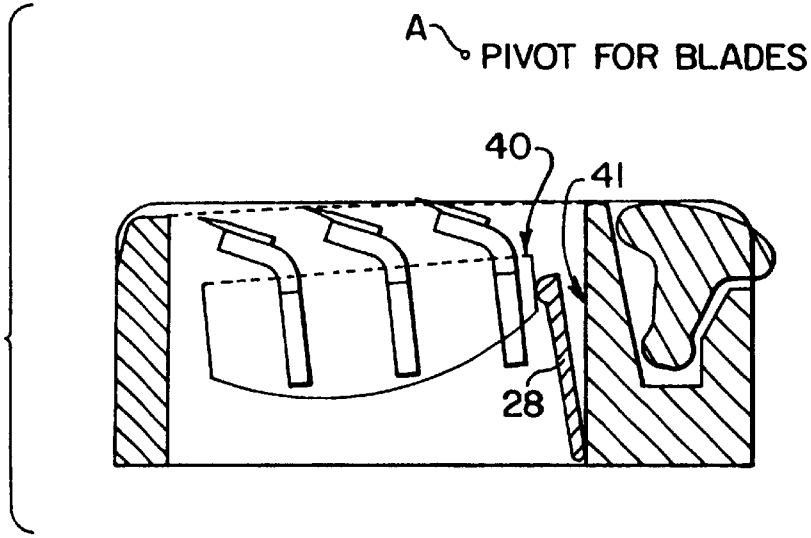

FIGS. 4 and 5 are views corresponding to FIGS. 2 and 3, respectively and showing a second embodiment of the invention; and FIGS. 6 and 7 are views corresponding to FIGS. 2 and 3 and illustrating a third embodiment of the invention.

Figure 8:
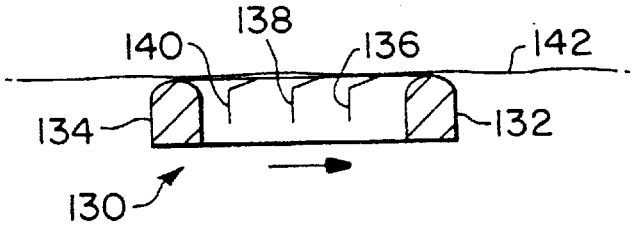
Figure 9:
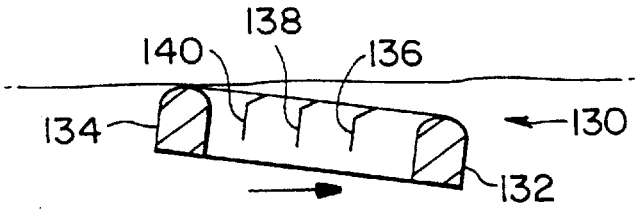
Figure 10:
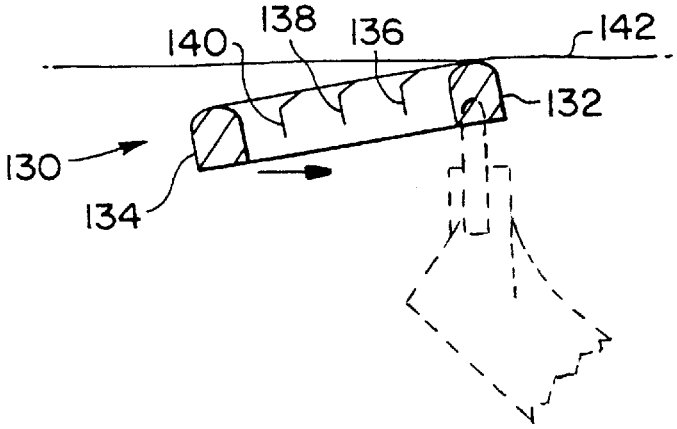

FIGS. 8–10 are illustrations of different orientations of a cartridge with respect to a shaver's skin.

Figure 11:
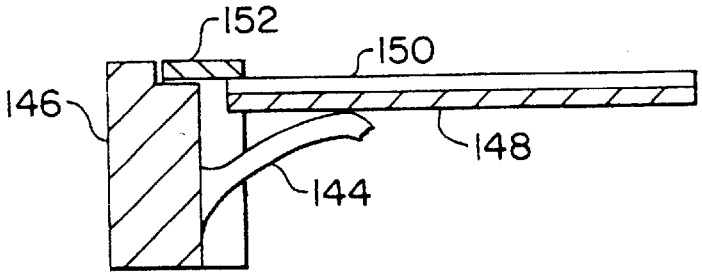

FIG. 11 is a cross-section through a further embodiment showing the use of cantilever arms for spring mounting of blades.

Figure 1:
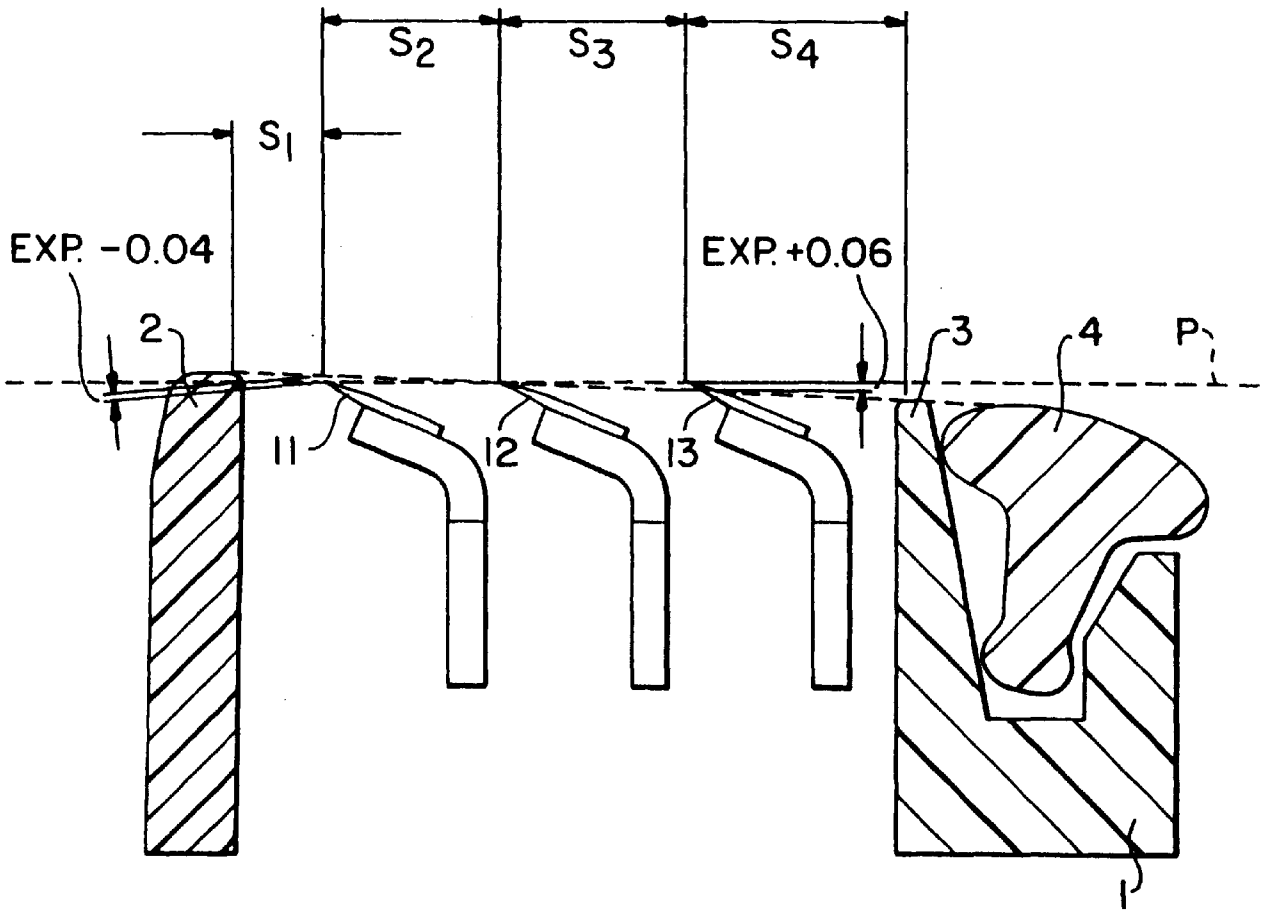
FIG. 1 illustrates a preferred blade geometry during shaving and corresponds to FIG. 2 of earlier application No. PCT/US94/10717.

FIG. 1 illustrates schematically a safety razor blade unit having a frame 1 defining a guard 2 and a cap 3 and mounting a lubricating strip 4. Supported by the frame and carried by respective support members are a primary blade 11, a secondary blade 12 and a tertiary blade 13, the blades having their edges lying in a common plane P. The target geometry of the blade unit is as follows:

a) The span $S_1$ of the primary blade 11 is 0.5 to 1.5 mm, and is preferably 0.7 mm;

b) The span $S_2$ of the secondary blade 12 and the span $S_3$ of the tertiary blade 13 are in the range of 1.0 to 2.0 mm, and each is preferably 1.5 mm;

c) The distance $S_4$ from the edge of the tertiary blade to the cap is about 1.80 mm;

d) The exposure of the primary blade is −0.04 mm;

e) The exposure of the secondary blade 12 is not less than the exposure of the primary blade 11 and not greater than the exposure of the tertiary blade 13 and, as shown, is equal to zero;

f) The exposure of the tertiary blade is about +0.09 mm.

Except as otherwise noted, the embodiments of the present invention described below are so arranged that a substantially similar blade target geometry can be achieved although such geometry does not apply when the blade unit is at rest and not in use (i.e., a non-shaving position not loaded by shaving forces).

In the blade unit shown in FIGS. 2 and 3, the guard 2 is mounted to the frame for up and down sliding movement between upper and lower end positions defined by stop surfaces provided on the frame. The guard is urged lightly to the upper end position by a spring 20. The cap 3 is similarly slidably mounted by the frame for up and down movement between end positions defined by stops, and a spring 21 lightly biases the cap to its upper end position. In the upper end position of the guard an upwardly facing shoulder 30 on the guard abuts a stop surface 31 defined by a flange 32 integral with the frame, as seen in FIG. 2. Similarly, in the upper end position of the cap an upwardly facing shoulder 34 on the cap abuts a stop surface 35 defined by a flange 36 integral with the frame. In the lower end positions of the guard and cap, the guard and cap respectively abut stop surfaces 37 and 38 defined by a bottom wall portion of the frame, as shown in FIG. 3. The three blades 11, 12, 13, can be stationarily mounted in the frame or can be biased by respective springs against a stop surface 18 defined by inturned flanges on the end walls of the frame. In the out of use condition, the blade geometry is outside the target geometry for the blades. The negative exposure of the primary blade has an absolute value significantly greater than 0.2 mm and the tertiary blade has a negative exposure. In use, the guard and cap can be depressed against the springs 20, 21 which act respectively thereon and occupy their lower end positions, as shown in FIG. 3, when in the start-shaving disposition a modified geometry (i.e., the target geometry) substantially corresponding to that of FIG. 1 is obtained. From this target geometry the blades may be deflected downwardly against their individual springs 19, but the enhanced shaving performance due to the target geometry need not be lost. Furthermore, it is not essential that the guard and cap remain in their lower end positions when they are in contact with the skin in use of the blade unit and they can be permitted to move under the influence of their respective springs 20, 21.

In the embodiment of FIGS. 4 and 5, the cap 3 and guard 2 are fixed to the frame as in FIG. 1, but the blades in this case are movable and influenced by respective springs 24. The springs could press the blades lightly upwardly against a stop surface (as mentioned in relation to FIGS. 2 and 3) but as shown the springs are unstressed when the blade unit is at rest and not in use so there is no preload on the blades. In this condition of the blade unit the target geometry for the blades is not satisfied, e.g., because the primary blade has a positive exposure, and the exposure of the tertiary blade is greater than the preferred maximum of +0.2 mm. In use, however, the blades are depressed against the force of the springs so that a modified geometry is obtained, as shown in FIG. 5, and substantially the target geometry of FIG. 1 can be obtained. If required the blades could be provided with stops to predetermine the positions to which they need to be deflected to reach the target geometry. Alternatively, the spring rates can be chosen so that deflection from positions according to the target geometry will not be excessive.

The embodiment of FIGS. 6 and 7 also has a stationary guard 2 and cap 3. The three blades 11, 12, 13 are mounted on a rocker unit 26 supported in the frame 1, such as by a shell bearing, for pivotal movement of the blades in unison about a pivot axis A located above the blade edges. A leaf spring 28 carried by the frame acts on the rocker urging it lightly to the non-shaving (i.e., at rest) position shown in FIG. 6, at which the blades are outside the target geometry for the blades, the primary blade having a positive exposure and the tertiary blade having a negative exposure. In use, forces applied will cause the rocker unit 26 to pivot against the action of the spring 28 and to take up the position which is shown in FIG. 7 and which may be predetermined by a stop fixed on the frame such as stop 40 or stop 41 indicated schematically in the drawings. In this condition of the blade unit the geometry is substantially as specified above in relation to FIG. 1, and hence the target geometry for the blades applies. As illustrated, the blades are fixedly mounted on the rocker but the blades may be mounted on the rocker by springs so that during shaving the blades may become deflected from the target geometry, as mentioned above in relation to FIGS. 2 and 3.

It will be understood that although in the at rest postion they do not initially satisfy the geometrical parameters to obtain the best shaving performance, all of the embodiments are adapted Do that these geometrical parameters will be obtained in use. While some embodiments have been described it will be appreciated that others are also possible within the scope of the claims. For example, just one of the guard and cap could be movable, or the blades and the guard and/or cap could be movable, or just one or two of the blades could be movable. Other combinations of movable elements are also possible. Futhermore, the elements could be adapted to move in a different manner, such as by the guard being arranged to flex or tilt and/or to move to vary the span of the primary blade as well as modify the blade exposure.

A feature of the guard and/or cap being movable and sprung as in the embodiment of FIGS. 2 and 3 is that when not in use the blade edges are all disposed below a plane tangential to the skin contacting surfaces of the guard and cap. However, the guard and/or cap can be readily displaced to the retracted position defined by a stop so that a desired target blade geometry is obtained.

It is believed that beneficial shaving results are achieved when cartridges with three resiliently mounted blades exhibit, during shaving, a "progressive force" pattern, i.e. the force on the tertiary blade is greater than the force on the primary blade and the force on the secondary blade is intermediate to the forces on the primary and tertiary blades or equal to the force on either the tertiary or the primary blade. The force pattern on the blades can be influenced by the cartridge orientation bias effect, blade geometry, and blade spring arrangement, as is discussed in detail below.

The cartridge orientation bias effect relates to how the angular orientation of the cartridge with respect to the skin surface influences the forces on the individual blades. FIGS. 8–10 illustrate three cartridge orientations, a neutral orientation, a cap-heavy orientation, and a guard-heavy orientation. In these figures, cartridge 130 is illustrated schematically to include a guard 132, cap 134 and blades 136, 138, 140 and is shown with a cartridge orientation relative to the skin surface 142 before the skin surface has been deflected. During actual shaving, the cartridges would in general be pushed into the skin surface, deflecting it so that the entire top part of the cartridge will contact the skin. If it is assumed that the exposures at rest (non-shaving condition), spring preloads and spring rates are equal for each of the blades, then the cartridge orientation will control the force pattern on the blades during shaving.

In FIG. 8, the cartridge 130 is oriented in the neutral condition. In this case, as the cartridge 130 is pressed against the skin surface 142 by the user to bring all of the blades into shaving contact, the forces are applied uniformly to the three blades. To produce a progressive force pattern, the blade geometry and/or the blade spring arrangement can be modified, as discussed in detail below.

In FIG. 9, the cartridge 130 has a cap-heavy orientation. In this case, the cap 132 contacts the skin surface initially. As the remainder of the top part of the cartridge is pushed against the skin, more force is applied to the blades near the cap. Accordingly, the force on the tertiary blade is greater than the force on the secondary blade, which is greater than the force on the primary blade, which is a progressive force pattern.

In FIG. 10, the cartridge 130 has a guard-heavy orientation. In this case, the guard 134 contacts the skin surface initially. As the remainder of the top part of the cartridge is pushed against the skin, more force is applied to the blades near the guard. Accordingly, the force on the primary blade is greater than the force on the secondary blade, which is greater than the force on the tertiary blade. The guard-heavy condition thus promotes the opposite of "progressive force." To produce a progressive force pattern, the blade geometry and/or the blade spring arrangement can be modified to counteract the force pattern that would otherwise be caused by the guard heavy condition, as discussed in detail below.

For cartridges that are not pivotally connected to the handle, the cartridge orientation with respect to the skin, and thus the cartridge orientation bias effect, is generally determined by the orientation of the cartridge with respect to the handle. For cartridges attached to the handle through a pivot, in addition to the at rest orientation of the cartridge, the pivot location and return spring force will affect the cartridge orientation bias effect. For example, if the at rest cartridge orientation is as shown in FIG. 9, the cap will initially contact the skin; however, if the pivot is in the region of the guard, and there is light return spring force, the cartridge will become guard heavy during shaving.

As noted above, the force pattern on the blades can also be influenced by the blade geometry and blade spring arrangement. The blade geometry refers to the exposure at rest. The blade spring arrangement refers to the spring rate and preload.

FIG. 11 illustrates one way of providing resilient mounting for the blades and how at rest exposure of a blade can be adjusted. (Other spring mounting approaches can also be used.) Referring to FIG. 11, cantilevered plastic arm 144 extends in from housing side wall 146 and provides resilient support for the bent upper portion 146 at one end of the blade. The cutting edge 150 of the blade is prevented from further upward movement by metal clip 152, which is secured to the housing. A similar arm extends in from the other side of the cartridge and provides resilient support for the other end of the blade under a similar retaining clip. The pair of arms 144 corresponds to springs 19, 24 shown in FIGS. 2–5. The upward force F that arm 144, acting as a cantilevered beam, exerts on blade portion 148 is a linear function of its downward displacement, y, from its unbiased position: $F=k*y$, where k is a spring constant that depends upon the length of the arm, L, the moment of inertia of the arm, I, and the modulus of elasticity, E ($k=L^3/(3EI)$). If arm 144 is deflected a distance $y_p$ by clip 152 in manufacture (i.e., providing arm 144 with a preload force $F_p$ of $k*y_p$) then y in the formula equals $y_p+y_d$, where $y_d$ equals the movement downward from the at rest position shown in FIG. 11.

The forces on the blades can be controlled in a variety of ways to cause a progressive force pattern during shaving. E.g., arm 144 can be provided with a different spring constant by changing the length of arm 144 or the moment of inertia (e.g., by providing a thicker cross-section for arm 144). Arm 144 can also be provided with a different preload force $F_p$ by keeping the same arm section and length, but moving the location at which the arm 144 is attached to housing side wall 146 upward (to increase preload force) or downward (to decrease preload force). The position or shape of clip 152 could also be adjusted relative to the arms to adjust preload force $F_p$; e.g., clip 152 could be mounted so that the portion contacting one blade is lower or higher than the portion contacting a different blade.

One way to achieve a progressive force pattern during shaving is to have an initial progressive exposure and the same preload force and spring constant for all blades. Another way to achieve a progressive force pattern during shaving is to have the same initial exposure (e.g., all zero) and to have progressive preload. A progressive preload can be provided by having the spring constant for the tertiary blade be higher than the spring constant for the second blade, and by having the spring constant for the primary blade be less than the spring constant for the second blade. A progressive preload can also be achieved by using the same arms (i.e., same spring constants) for all blades, but having the second arm mounted higher than the primary blade and the third arm mounted higher than the second.

The springs, preloads and initial exposures can be used in combination with the cartridge orientation bias effect to produce progressive exposure and/or a progressive force pattern. For example, if the cartridge has a guard-heavy orientation (e.g., a cap first orientation though with a pivot in the proximity of the guard and a light return spring, as noted above), progressive geometry in use can be effected with higher preloads, spring constants, and at-rest exposures on the tertiary and secondary blades than on the primary blade. Other combinations that can be used to promote a progressive force during shaving include a higher preload, spring constant, or at rest exposure on the third blade than on the first blade or combinations of these parameters having higher values on the third blade as compared to the first blade. Preferably the second blade would have intermediate values or values that are the same as the third blade in order to promote the progressive force pattern.

The spring preloads are typically in the range of about 25 g or less. The force on the individual blades would be expected to be in the range of about 0–40 g, with between zero and 20 gms on the first blade, and between greater than zero and less than 40 gms on the third blade. Typically the forces on the individual blades would be greater than 5 gm. At rest exposures and exposures during shaving typically are in the ranges noted earlier.

What is claimed is:

1. A safety razor blade unit comprising a guard, a cap, and first, second and third parallel blades each with sharpened cutting edges located between the guard and cap, said third blade being nearer the cap than is said first blade, at least one element selected from the three blades, the guard and the cap being movable against a spring bias, in response to a user bringing the razor blade unit into contacting relation with skin to be shaved, from an at-rest position unloaded by externally applied forces to a depressed start-shaving position to modify a blade exposure dimension of the blade unit and at in said depressed position a target blade geometry, wherein in said target geometry the exposure of the first blade is less than zero and the exposure of the third blade is greater than zero, at least one of the first and third blades having a different exposure when tXe at least one movable element is in the at-rest position, and wherein when said first and third blades are depressed by an equal amount, the force exerted on said first blade is less than the force exerted on said third blade, and said spring bias biasing the at least one element to the at-rest position upon removal of externally applied forces, and the three blades being independently mounted for spring-biased movement so that during shaving the blade movement from respective shaving positions is translational without changing respective blade angles.

2. A safety razor blade unit according to claim 1, wherein the at least one element is movable from the non-shaving position to the depressed position defined by a displacement limiter applying a force opposing further motion in the displacement direction.

3. A safety razor blade unit according to claim 1, wherein in said target blade geometry the span between the first blade edge and the guard is substantially equal to 0.7 mm.

4. A safety razor blade unit according to claim 1, wherein the at least one movable element is biased by the spring to an end position defined by a stop.

5. A safety razor blade unit according to claim 1, wherein the at least one movable element comprises the guard.

6. A safety razor blade unit according to claim 1, wherein the at least one movable element comprises the cap.

7. A safety razor blade unit according to claim 1, wherein in said target blade geometry the second blade has an exposure not less than the exposure of the first blade and not greater than the exposure of the third blade.

8. A safety razor blade unit according to claim 7, wherein in said target blade geometry the exposure of the second blade is substantially equal to zero.

9. A safety razor blade unit according to claim 1, wherein in said target blade geometry the span between the edge of the third blade and the edge of the second blade is in the range of 1.0 and 2.0 mm.

10. A safety razor blade unit according to claim 9, wherein in said target blade geometry the span between the edges of the first and second blades and/or between the edges of the second and third blades is substantially equal to 1.5 mm.

11. A safety razor blade unit according to claim 1, wherein in said target blade geometry the exposure of the third blade has a positive value substantially equal in magnitude to the negative value of the exposure of the first blade.

12. A safety razor blade unit according to claim 1, wherein in said target blade geometry the span between the first blade edge and the guard is substantially smaller than the span between the edges of the first and second blades and the span between the edges of the second and third blades.

13. A safety razor blade unit according to claim 1, wherein in said target blade geometry the span between the edge of the second blade and the edge of the first blade is in the range of 1.0 to 2.0 mm.

14. A safety razor blade unit according to claim 1, wherein in said target blade geometry the exposure of the first blade has a negative exposure with an absolute value in the range of 0 to 0.2 mm.

15. A safety razor blade unit according to claim 14, wherein in said target blade geometry the span between the first blade edge and the guard is in the range of 0.5 mm to 1.5 mm.

16. A safety razor blade unit according to claim 14, wherein in said target blade geometry the exposure of the first blade is substantially equal to −0.04 mm.

17. A safety razor blade unit according to claim 1, wherein in said target blade geometry the exposure of the third blade has a positive value not greater than +0.3 mm.

18. A safety razor blade unit according to claim 1, wherein in the at-rest positions the third blade has a more positive exposure than the first blade.

19. A shaving cartridge comprising a housing having connecting structure adapted to make a removable connection to a handle, a guard at the front of the cartridge, a cap at the back of the cartridge, and first, second and third parallel blades each with sharpened skin-contacting cutting edges located on said housing between said guard and cap and independently mounted for spring-biased movement with respect to said housing, said third blade being nearer the cap than is said first blade, said blades being movable from initial at-rest positions determined by respective exposures of the blades to shaving positions, wherein said third blade has a higher preload than said first blade, such that when said first and third blades are depressed by an equal amount, the force exerted on said first blade is less than the force exerted on said third blade.

20. The cartridge of claim 19, wherein said second blade has a higher preload than said first blade.

21. The cartridge of claim 19, wherein said third blade further has a higher exposure at rest than said first blade.

22. The cartridge of claim 19, wherein said third blade further has a higher spring constant than said first blade.

23. The cartridge of claim 19, wherein said third blade further has a higher exposure at rest and higher spring constant than said first blade.

24. The cartridge of claim 19, wherein said second and third blades have higher exposure at rests than said first blade and said second blade also has a higher preload than said first blade.

25. The cartridge of claim 19, wherein said second and third blades have higher spring constants than said first blade and said second blade also has a higher preload than said first blade.

26. The cartridge of claim 19, wherein said second and third blades have higher exposure at rests and higher spring constants than said first blade and said second blade also has a higher preload than said first blade.

27. A shaving cartridge comprising a housing having connecting structure adapted to make a connection to a handle, a guard at the front of the cartridge, a cap at the back of the cartridge, and first, second and third parallel blades each with sharpened skin-contacting cutting edges located on said housing between said guard and cap and independently mounted for spring-biased movement with respect to said housing, said third blade being nearer the cap than is said first blade, said blades being movable from initial at-rest positions determined by respective exposures of the blades to shaving positions, the three blades being mounted so that during shaving the blade movement from respective shaving positions is translational without changing respective blade angles, wherein when said first and-third blades are depressed by an equal amount, the force exerted on said first blade is less than the force exerted on said third blade.

28. A safety razor blade unit according to claim 27, wherein in the at-rest positions the third blade has a more positive exposure than the first blade.

29. The cartridge of claim 27, wherein said housing has pivoting structure for providing pivoting of said housing about a pivot axis.

30. The cartridge of claim 29, wherein said pivot axis is in front of blades in the region of said guard.

31. The cartridge of claim 27, wherein said third blade has a higher exposure at rest and a higher spring constant than said first blade.

32. The cartridge of claim 27, wherein said second and third blades have higher exposure at rests and higher spring constants than said first blade.

33. The cartridge of claim 27, wherein the preload force on said first blade is between zero and 20 gms and the preload force on said third blade is greater than zero and less than 40 gms.

34. The cartridge of claim 27, wherein said third blade has a higher spring constant than said first blade.

35. The cartridge of claim 27, wherein said third blade has a higher exposure at rest than said first blade.

36. The cartridge of claim 27, wherein when all of said three blades are depressed by an equal amount the force on the first blade is less than the force on the second blade, and the force on the second blade is less than or equal to the force on the third blade.

37. The cartridge of claim 36, wherein said second and third blades have higher spring constants than said first blade.

38. The cartridge of claim 36, wherein said second and third blades have higher exposure at rests than said first blade.

39. A shaving razor comprising a handle, a housing having connecting structure adapted to make a removable connection to the handle, a guard at the front of the cartridge, a cap at the back of the cartridge, and first, second and third parallel blades each with sharpened skin-contacting cutting edges located on said housing between said guard and cap and independently mounted for spring-biased movement with respect to said housing, said third blade being nearer the cap tan is said first blade, said blades being movable from initial at-rest positions determined by respective exposures of the blades to shaving positions, wherein said third blade has a higher preload than said first blade, such that when said first and third blades are depressed by an equal amount, the force exerted on said first blade is less than the force exerted on said blade.

40. The cartridge of claim 39, wherein said third blade further has a higher exposure at rest than said first blade.

41. The cartridge of claim 39, wherein said second blade has a higher preload than said first blade.

42. The cartridge of claim 39, wherein said third blade further has a higher spring constant than said first blade.

43. The cartridge of claim 35, wherein said third blade further has a higher exposure at rest and higher spring constant than said first blade.

44. The cartridge of claim 39, wherein said second and third blades have higher exposure at rests than said first blade and said second blade also has a higher preload than said first blade.

45. The cartridge of claim 39, wherein the three blades are mounted for the independent spring-biased movement so that during shaving the blade movement from respective shaving positions is translational without changing respective blade angles.

46. The cartridge of claim 39, wherein said second and third blades have higher spring constants than said first blade and said second blade also has a higher preload than said first blade.

47. The cartridge of claim 39, wherein said second and third blades have higher exposure at rests and higher spring constants than said first blade and said second blade also has a higher preload than said first blade.

48. A safety razor blade unit comprising a guard a cap and at least three parallel blades each with sharpened cutting edges located in succession between the pad and the cap, at least one of the guard and the cap being movable against a spring force, in response to a user bringing the razor blade unit into contacting relation with skin to be shaved but prior to beginning a shaving stroke generally parallel to the skin, from an at-rest position unloaded by externally applied forces to a predetermined operable depressed position in which a target blade geometry is obtained, the three blades being independently mounted for spring-biased movement so that during shaving the blade movement from respective operable positions is translational without changing respective blade angles, wherein when said first and third blades are depressed by an equal amount, the force exerted on said first blade is less than the force exerted on said third blade, and wherein in the at-rest position the blade edges are disposed below a plane tangential to the skin contacting surfaces of the guard and the cap.

49. A shaving cartridge comprising a housing having connecting structure adapted to make a connection to a handle, a guard at the front of the cartridge, a cap at the back of the cartridge, and first, second and third parallel blades each with sharpened skin-contacting cutting edges located on said housing, between said guard and said cap and independently mounted for spring-biased movement with respect to said housing, said third blade being nearer the cap than is said first blade, said blades being movable against the spring bias, in response to a user bringing the razor blade unit into contacting relation with skin to be shaved wherein skin contacting surfaces of the guard, cap and three blades bear on the surface to be shaved, from at-rest positions unloaded by externally applied forces to depressed start-shaving positions wherein a target blade geometry is attained in which the exposure on the first blade is less than zero and the exposure on their blade is greater than zero, the three blades being mounted so that during shaving the blade movement from respective shaving position is translational without changing respective blade angles, and wherein when said first and third blades are depressed by an equal amount, the force exerted on said first blade is less than the force exerted on said third blade.

50. The cartridge of claim 49, wherein in said shaving positions the exposure on the first blade is less than or equal to the exposure on the second blade, and the exposure on the second blade is less than or equal to the exposure on the third blade.

51. A safety razor blade unit according to claim 49, wherein in the at-rest positions the third blade has a more positive exposure than the first blade.

52. A shaving razor comprising a handle, a housing connected to said handle, a guard at the front of the cartridge, a cap at the back of the cartridge, and first, second and third parallel blades each with sharpened skin-contacting cutting edges located on said housing between said guard and cap and independently mounted for spring-biased movement with respect to said housing, said third blade being nearer the cap than is said first blade, said blades being movable from initial at-rest positions determined by respective exposures of the blades to shaving positions, the three blades being mounted so that during shaving the blade movement from respective shaving positions is translational without changing respective blade angles, wherein when said first and third blades are depressed by an equal amount the force exerted on said first blade is less than the force exerted on said third blade.

53. A safety razor blade unit according to claim 52, wherein in the at-rest positions the third blade has a more positive exposure the first blade.

54. The shaving razor of claim 52, wherein said housing is connected to said handle by a pivot is closer to said guard than it is to said cap.

* * * * *